US007874344B2

(12) United States Patent
Browne et al.

(10) Patent No.: US 7,874,344 B2
(45) Date of Patent: Jan. 25, 2011

(54) METHOD FOR PRODUCING A FUNCTIONALLY GRADIENT COMPONENT

(76) Inventors: David Browne, Department of Mechanical Engineering, University College Dublin, Belfield, Dublin (IE) 4; Peadar Tiernan, Department of Mechanical Engineering, University College Dublin, Belfield, Dublin (IE) 4; Andrew Bates, 21 Longwood Avenue, Portabello, Dublin (IE) 8; Michelle Scanlan, Rathconnell, Mullingar, County Westmeath (IE); Stephen Kelly, 32 Woodbrook Park, Templeogue, Dublin (IE) 6

( * ) Notice: Subject to any disclaimer, the term of this patent is extended or adjusted under 35 U.S.C. 154(b) by 736 days.

(21) Appl. No.: 11/632,706

(22) PCT Filed: Jul. 25, 2005

(86) PCT No.: PCT/EP2005/008137

§ 371 (c)(1),
(2), (4) Date: Oct. 2, 2007

(87) PCT Pub. No.: WO2006/010601

PCT Pub. Date: Feb. 2, 2006

(65) Prior Publication Data

US 2008/0107916 A1 May 8, 2008

(30) Foreign Application Priority Data

Jul. 26, 2004 (IE) ..... S2004/0502

(51) Int. Cl.
*B22D 19/16* (2006.01)

(52) U.S. Cl. ..... 164/94; 164/95

(58) Field of Classification Search ..... 164/91, 164/94, 95

See application file for complete search history.

(56) References Cited

U.S. PATENT DOCUMENTS 2,841,846 A * 7/1958 Otani ..... 75/244
3,192,581 A * 7/1965 Sylvester ..... 164/66.1

FOREIGN PATENT DOCUMENTS

| | | |
|---|---|---|
| DE | 2 355 745 | 5/1974 |
| JP | 56-9044 A | 1/1981 |
| SU | 997970 | 2/1983 |

OTHER PUBLICATIONS

International Search Report dated Apr. 4, 2006 (Six (6) pages).

* cited by examiner

*Primary Examiner*—Kevin P Kerns
(74) *Attorney, Agent, or Firm*—Sullivan & Worcester LLP; John W. Ryan

(57) ABSTRACT

A method for producing a functionally gradient component, such a component having an outer layer of a first material, and an inner core of a second material, there being a gradual change in microstructure across the interface between the two materials, the method having particular application in producing a component formed from two or more aluminium alloys based on the aluminium-silicon (Al—Si) system, the method involving introducing a first molten metal into a mould, and allowing a layer of the first metal to partially solidify against a wall of the mould, decanting the remaining molten portion of the first metal, and introducing a second molten metal into the mould and allowing same to solidify.

9 Claims, 7 Drawing Sheets

METHOD FOR PRODUCING A FUNCTIONALLY GRADIENT COMPONENT

FIELD OF THE INVENTION

The present invention is concerned with a method for producing a functionally gradient component, in particular a component formed from two or more materials such as metal, and more particularly a component formed from two or more aluminium alloys based on the aluminium-silicon (Al—Si) system, or other binary or multicomponent alloys such as Cu—Sn or Fe—C.

BACKGROUND OF THE INVENTION

There is a clear need in engineering for light weight yet wear resistant parts, produced in an economic manner. Typically, materials which are resistant to wear are often inherently brittle, and therefore if used in moving parts which are dynamically loaded (for example in an engine), there is a risk of fracture. One way of overcoming this problem is via the application of a hard wearing exterior coating to a tough and ductile core, for example a ceramic coating on a metal core. The conventional means of providing such wear resistant surface coatings are based on plasmas, e.g. physical vapour deposition (PVD), chemical vapour deposition (CVD), or the like, and thus require expensive equipment, while only depositing a very thin layer, normally in the order of micrometers, which will quickly wear during use. In addition, in coated substrates, severe stresses may build up when the component is subject to heating or cooling, due to the mismatch of thermal expansion co-efficients between the coating and its substrate. This may result in spalling the coating, and delamination of the substrate-coating interface.

Another light yet wear resistant material is a metal matrix composite (MMC). This is a material with a metallic matrix incorporating reinforcing ceramic particles, for example of silicon carbide (SiC). It is however problematic to ensure proper adhesion (wetting) between such particles and the metallic matrix, normally aluminium. In addition, when these materials are melted for casting, the ceramic particles tend to agglomerate or sediment to the bottom of the component. Porosity is a feature of materials thus processed, and is very difficult to avoid. The raw materials are also relatively expensive.

Spray casting is a further method by which fine microstructures may be formed in hypereutectic Al—Si alloys. The process involves atomisation of a stream of molten metal with an inert gas, and deposition onto a moving substrate making the process relatively expensive, and incapable of producing components to a near net shape—only preliminary shapes may be produced, which require subsequent processing to form useful components.

It is therefore an object of the present invention to provide a novel method of producing a functionally gradient component comprising at least one outer layer of a first material having certain physical characteristics, and an inner core of a second material having different physical characteristics, with a gradual change in microstructure between the first and the second material.

SUMMARY OF THE INVENTION

The present invention therefore provides a method of producing a functionally gradient component, the method comprising introducing a first material, in a molten state, into a mould; allowing a layer of the first material to at least partially solidify against a wall of the mould; decanting the remaining molten portion of the first material; and introducing a second material, in a molten state, into the mould.

Preferably, the method comprises undertaking at least the decanting step in a reducing gas atmosphere.

Preferably, the method comprises introducing the second material into the mould at a sufficiently short interval after the decanting of the first material, to substantially prevent oxidation of the layer of the first material.

Preferably, the method comprises altering the temperature at one or more locations on the wall of the mould, prior to introducing the first material, in order to achieve a desired thickness of the layer of the first material at said one or more locations.

Preferably, the method comprises introducing the first material into the mould under pressure.

Preferably, the method comprises introducing the second material into the mould under pressure.

Preferably, the method comprises the step of pre-heating the mould prior to the introduction of the first material.

Preferably, the method comprises maintaining the second material under pressure within the mould until the second material has substantially solidified.

Preferably, the method comprises allowing a layer of the second material to at least partially solidify on the layer of the first material; decanting the remaining molten portion of the second material; and introducing a third material, in a molten state, into the mould.

As used herein, the term "functionally gradient component" is intended to mean a component having an outer layer of a first material, and an inner core of a second material, there being a gradual change in microstructure across the interface between the two materials.

As used herein, the term "molten state" is intended to mean that state of a material, for example a metal, which is normally achieved by heating the material to a certain temperature or within a certain temperature range and which will allow the material to flow, for example into or out of a mould or the like, whether under the influence of gravity or with additional assistance, and to conform to the shape of the mould.

As used herein, the term "component" is intended to mean a finished or substantially finished end product ready for use in an intended application, in addition to meaning a product which may require one or more subsequent processing steps prior to be considered a finished product or being ready for use in a particular application.

BRIEF DESCRIPTION OF THE DRAWINGS

The present invention will now be described with reference to the accompanying drawings, in which.

DETAILED DESCRIPTION OF THE DRAWINGS

Figure 1:
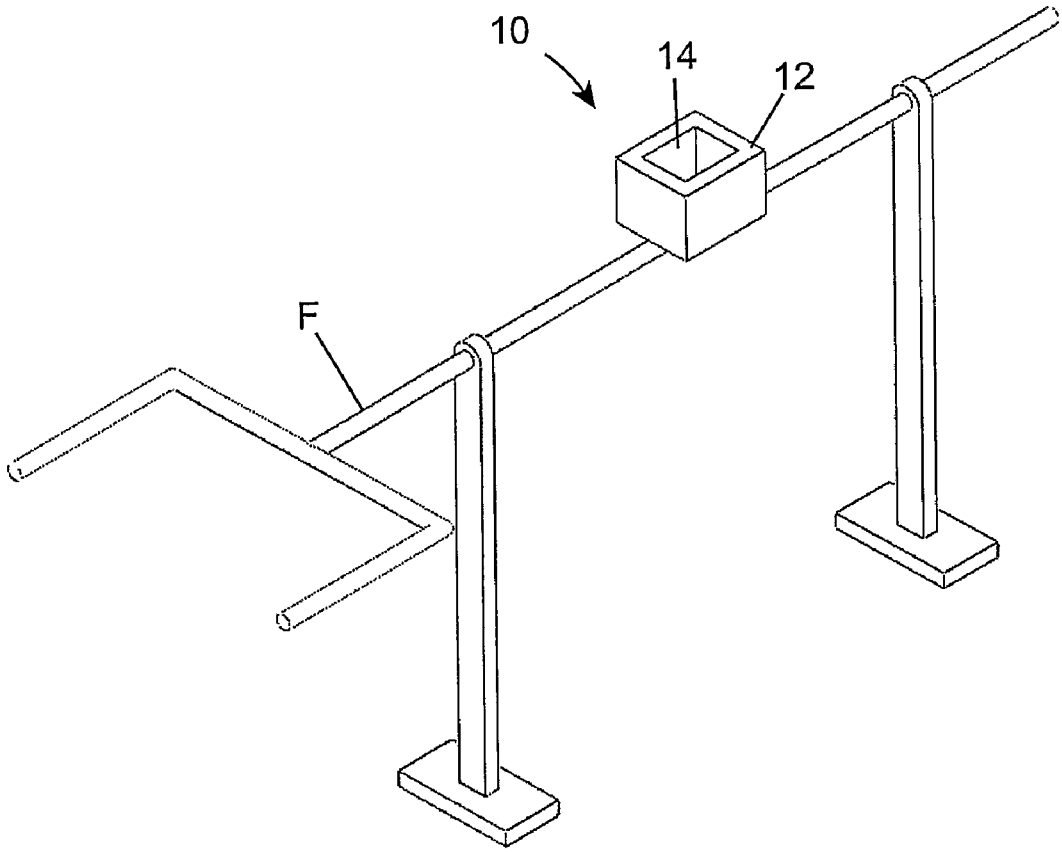
FIG. 1 illustrates a perspective view of a first embodiment of an apparatus for performing the method of the present invention.

Referring now to FIG. 1 of the accompanying drawings, there is illustrated a first embodiment of an apparatus according to the present invention, generally indicated as 10, for performing the method of producing a functionally gradient component according to the present invention. Throughout the following description, the method of the present invention is described primarily with reference to the use of alloys based on the aluminium-silicon (Al—Si) system, in particular hypereutectic and hypoeutective Al—Si alloys. However, the method of the present invention is in no way limited to the use of these alloys or other metallic alloys, and may be used with almost any materials which can be converted to a molten state for casting, for example thermoplastics or the like. The choice of hypereutectic and hypoeutectic Al—Si alloys simply reflects their dominance in the manufacture of lightweight and wear resistant components in a large number of industries, for example the automotive, aerospace and robotics industry.

Hypereutectic alloys have a microstructure of silicon needles in a eutectic matrix, and are hard, but brittle if monolithic. Hypoeutectic alloys have a microstructure of pure aluminium phase surrounded by a two phase eutectic matrix. Such alloys are generally tough and ductile, and useful as a structural material. The method of the present invention, as will be described in detail hereinafter, is capable of producing a component with a surface of hypereutectic composition and microstructure, but with a central core of hypoeutectic composition with a gradual change in microstructure between the two. This gives a wear resistant surface but a tough core, these being ideal properties of many components used in mechanical engineering.

Thus the apparatus 10 of the first embodiment, as illustrated in FIG. 1, comprises a substantially conventional mould 12 fixed to a rotatable frame F, such that the mould 12 may be held upright as illustrated, or inverted in order to decant material therefrom. It will therefore be appreciated that the Frame F could be of any suitable shape and/or configuration, operable to invert the mould 12.

The mould 12 defines a cavity 14 in the negative of the shape of a component (not shown) to be produced, which for illustrative purposes is a simple rectangular block. Al—Si alloy of hypereutectic composition (hereinafter referred to as material A) is melted, and poured into the cavity 14. Heat from material A is extracted via the mould 12, and thus the material next to the mould 12 cools and solidifies first. The thickness of the solid skin grows with time, until it is deemed to be of the correct thickness, wherein the mould 12 is inverted by means of the frame F, the remaining liquid material A therefore being decanted. This leaves a layer of material A solidified along the walls of the mould 12. The thickness of the layer of material A will vary depending on the application of the functionally gradient component (not shown) produced, and the conditions under which said component will operate. Other factors may of course influence the thickness of the layer of material A, for example the cost of producing the component. The material A decanted from the mould 12 is preferably maintained in a molten state in a suitable reservoir (not shown), to be used in producing subsequent components within the mould 12.

The mould 12 is then returned to the upright position, and a hypoeutectic Al—Si alloy (hereinafter referred to as material B) poured in to fill the remaining space in the cavity 14. If material B is poured into the cavity 14 a sufficiently short interval after the decanting of material A, the layer of material A does not have time to oxidise, and consequently there is no final visible interface between the outer layer of material A and the core of material B. If the method is performed in a reducing gas atmosphere, such oxidation does not occur even for long exposure times.

The lack of a distinct interface between material A and material B is also due to the re-melting of the exposed surface of material A by the addition of the molten material B. Convection and mixing in the liquid zone removes the steep composition gradient between material A and material B. In this way, there is a gradual variation in composition and microstructure, from material A to material B, for example from an outer hypereutectic layer to an inner hypoeutectic core. The result is a functionally gradient material (FGM) or component, in which there is an outer layer having certain mechanical properties, for example being hard and wear resistant, and a core having different mechanical properties, for example being softer, but tougher and more ductile. Such a functionally gradient component is also less sensitive to stresses which may build up when a component is heated or cooled, as despite there being a likely difference in the thermal coefficient of the two materials forming the functionally gradient component, the gradual change in microstructure from one to the other, as described in detail hereinafter, minimises the effect of the above mentioned stresses.

Referring specifically to hypereutectic and hypoeutectic Al—Si alloys, the hypereutectic outer layer is allowed to solidify relatively rapidly, resulting in a fine wear resistant surface microstructure. Because the interior liquid hypereutectic alloy is decanted, severe stresses are not set up in the centre of the component to be formed, and also the formation of the large and problematic needles of silicon are avoided, and will not be present in the final component as the central or core alloy will be hypoeutectic. If the entire component were cast from hypereutectic alloy, in order to obtain the hard wear resistant surface, the surface of the component would solidify first, and relatively quickly, but the interior would solidify more slowly, leading to the formation of large silicon needles, which are inherently brittle. Due to stresses caused by solidification and shrinkage, the casting could even break apart before being completely solidified. Even if the casting did not break, the large internal needle shaped silicon crystals would provide a path for crack propagation, making the material brittle. These are some of the problems that are avoided with the method of the present invention.

Furthermore, the component produced by the method of the present invention, due to its hypereutectic surface, having high silicon content, has superior surface thermal properties, namely increased strength at high temperature, and higher insulating properties. These are beneficial properties as in wear situations, friction causes heat, and it is important that the resultant high temperatures do not soften the material A. Furthermore, the gradient in the composition from material A to material B renders the material more resistant to thermal fatigue, a condition in which fluctuating or alternating stresses are caused by changes in temperature.

Figure 2:
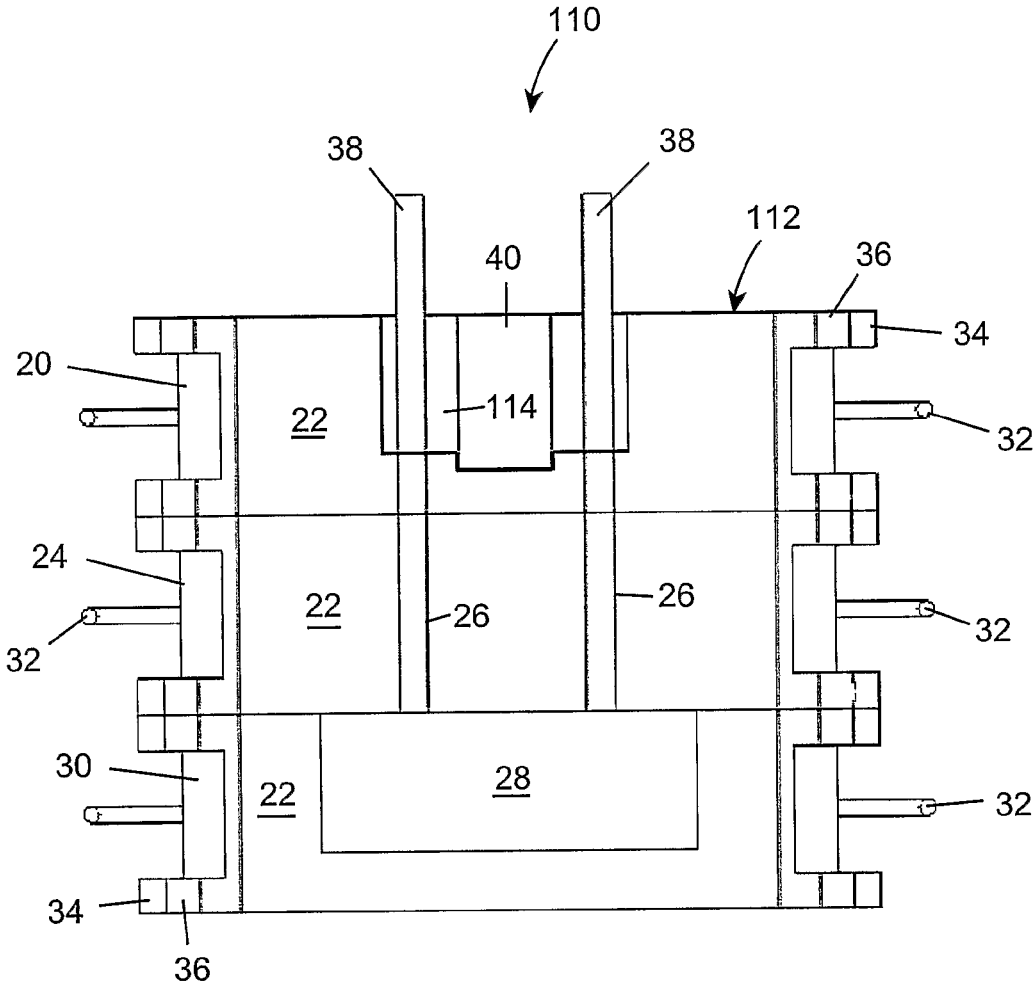
FIG. 2 illustrates a sectioned side elevation of a second embodiment of an apparatus for performing the method of the present invention.

Referring now to FIG. 2 of the accompanying drawings, there is illustrated a second embodiment of an apparatus according to the present invention, generally indicated as 110, being an exemplary means of performing the method of the present invention. The apparatus 110 again comprises a mould 112 defining a cavity 114 for casting a functionally gradient component (not shown) therein. The mould 112 is formed from a first sand box 20 of conventional form, the interior of the sand box 20 being filled with compacted sand 22 in order to define the cavity 114, as is conventional foundry practice. It will of course be appreciated that the first sand box 20 and associated sand 22 could be replaced with a mould (not shown) formed from any other suitable material, for example a metal having a higher melting point that the material to be cast within the cavity 114, or a ceramic material.

The first sand box 20 is mounted above a similar second sand box 24, again being filled with compacted sand 22, to define a pair of channels 26 extending downwardly from a base of the cavity 114. The pair of channels 26 extend into a reservoir 28, which is defined within a third sand box 30 being filled with compact sand 22 in order to define the reservoir 28.

Each sand box 20, 24, 30 is provided with a pair of oppositely disposed handles 32 in order to facilitate the lifting/positioning thereof. In addition, each sand box 20, 24, 30 is provided with a lug 34 at each corner thereof, each lug 34 defining a bore 36 therethrough. Thus, when the sand boxes 20, 24, 30 are stacked one on top of another, the bores 36 in adjacent lugs 34 are aligned, and thus locating pins (not shown) may be passed therethrough in order to secure the sand boxes 20, 24, relative to one another.

In use, a pair of rods 38, preferably formed from carbon or any other material having a suitably high melting point, are inserted downwardly through the cavity 114, and into the channels 26 in order to occlude same, such that molten material may be introduced into the cavity 114 and will not drain downwardly through the channels 26 into the reservoir 28.

Again in describing the method of the present invention as implemented with the apparatus 110, reference will be made to material A, preferably a hypereutectic Al—Si alloy, and material B, preferably a hypoeutectic Al—Si alloy. Initially, material A and material B are melted, for example in a suitable furnace, such as an induction furnace or the like. Material A is then poured into the cavity 114 in order to fill same. It should be noted that the cavity 114 is annular in form, having a central core 40, for example formed from stainless steel or the like. Thus the apparatus 110 is adapted to produce an annular component, for example a bushing (not shown) or the like with an inner surface composed of material A. While material A is being allowed to solidify around the perimeter of the cavity 114, the pair of rods 38 are maintained in position as shown. When the solidifying layer of material A has reached the desired thickness, the pair of rods 38 are drawn upwardly out of the channels 26, thereby allowing the remaining molten material A to drain downwardly into the reservoir 28. The pair of rods 38 are positioned, when secured within the channels 26, a sufficient distance from the walls of the cavity 114 in order to allow a solidified layer of material A to form.

Once the rods 38 have been removed, and the molten material A has drained into the reservoir 28, a molten material B is then introduced into the cavity 114, around the semi-solid layer of material A. Material B does not drain through the channels 26 as there is a sufficient volume of material A to fill both the reservoir 28 and the channels 26. The rods 38 may be heated or made from an insulating material to avoid any metal solidification on the rods 38 themselves.

The introduction of the molten material B effects re-melting of the interface between material A and material B, thus resulting in a gradient in the micro-structure and properties between material A and material B, instead of a step change. Again it is preferable that the method is performed in a reducing gas atmosphere, or at least the steps of decanting material A, and casting material B.

The apparatus 110 thus enables the method of the present invention to be performed, in order to produce a functionally gradient component.

Referring now to FIGS. 3 to 6, there is illustrated a third embodiment of an apparatus, generally indicated as 210, for performing the method according to the present invention. Again in describing this third embodiment, reference will be made to material A, having certain mechanical properties, and material B, having differing mechanical properties, material A preferably being hypereutectic Al—Si alloy, and material B preferably being hypoeutectic Al—Si alloy.

The apparatus 210 comprises a mould 212 defining a cavity 214 in the negative shape of a component (not shown) to be cast. The cavity 214 is primarily defined within a first sand box 220, filled with compact sand 222 in order to define the shape of the cavity 214, as is conventional foundry practice. The first sand box 220 is mounted atop a second sand box 224, which is also filled with compact sand 222, and defines a lower portion of the cavity 214. It will of course be appreciated that the entire cavity 214 could be contained within the first sand box 220. It will also be appreciated that the sand boxes 220, 224 could be replaced with any other suitable mould (not shown), formed from any suitable material. Extending from the cavity 214 are a pair of channels 226, for introducing and removing material A and material B from the cavity 214, as will be described in detail hereinafter. The sand boxes 220, 224, are also preferably provided with a pair of handles 232 each, for lifting and positioning same.

The apparatus 210 further comprises a crucible 50 releasably engagable with the second sand box 224, the crucible 50 being of standard refractory type, and being divided into a first chamber 52 and a second chamber 54 for receiving material A and material B respectively. The crucible 50 is shown in isolation in FIG. 4.

Figure 5:
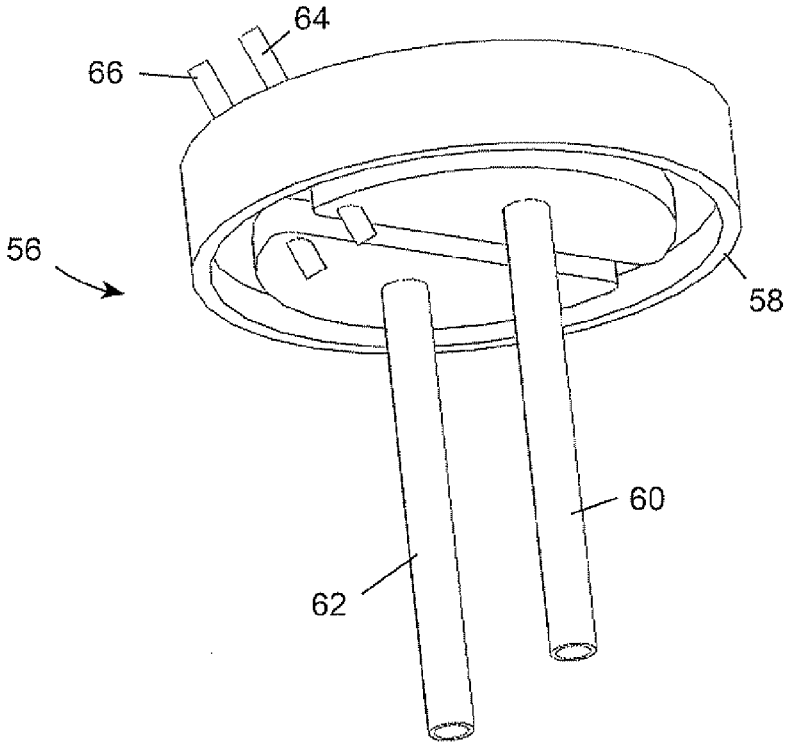
FIG. 5 illustrates a perspective view of a lid for the crucible illustrated in FIG. 4.

The apparatus 210 further comprises a lid 56 for the crucible 50, as illustrated in isolation in FIG. 5. The lid 56 is shaped and dimensioned to provide a pressure tight seal between the crucible 50 and the lid 56. To this end, the lid 56 is provided with a rim 58 for receiving the upper end of the crucible 50, about which a sealing compound may be provided.

Alternately, a gasket (not shown) may be used between the lid 56 and the top of the crucible 50. Pressure is applied to squeeze the gasket (not shown) between the crucible 50 and the lid 56 in order to form a pressure tight seal.

Alternately, the lid 56 may be made from a ceramic fibre material and compressed onto the top of the crucible 50, thus forming a pressure tight seal.

Extending through the lid 56 is a first feed tube 60 which is located, in use, within the first chamber 52, and a second feed tube 62 which is located, in use, within the second chamber 54. The first and second feed tubes 60, 62 are preferably formed from graphite or ceramic material, or any other material which is capable of withstanding the heat of molten material A and material B. The first and second feed tubes 60, 62 are dimensioned to extend to a position adjacent a base of the crucible 50.

Also extending through the lid 56 is a first pump tube 64 which is thus located, in use, within the first chamber 52, and a second pump tube 66 which is located, in use, within the second chamber 54. The first and second pump tubes 64, 66 are dimensioned to terminate within the upper portion of the crucible 50. The first and second pump tubes 64, 66 are also located such as to exit the lid 56 adjacent the perimeter thereof, in order to be accessible when the second sand box 224 is seated atop the lid 56.

Figure 3:
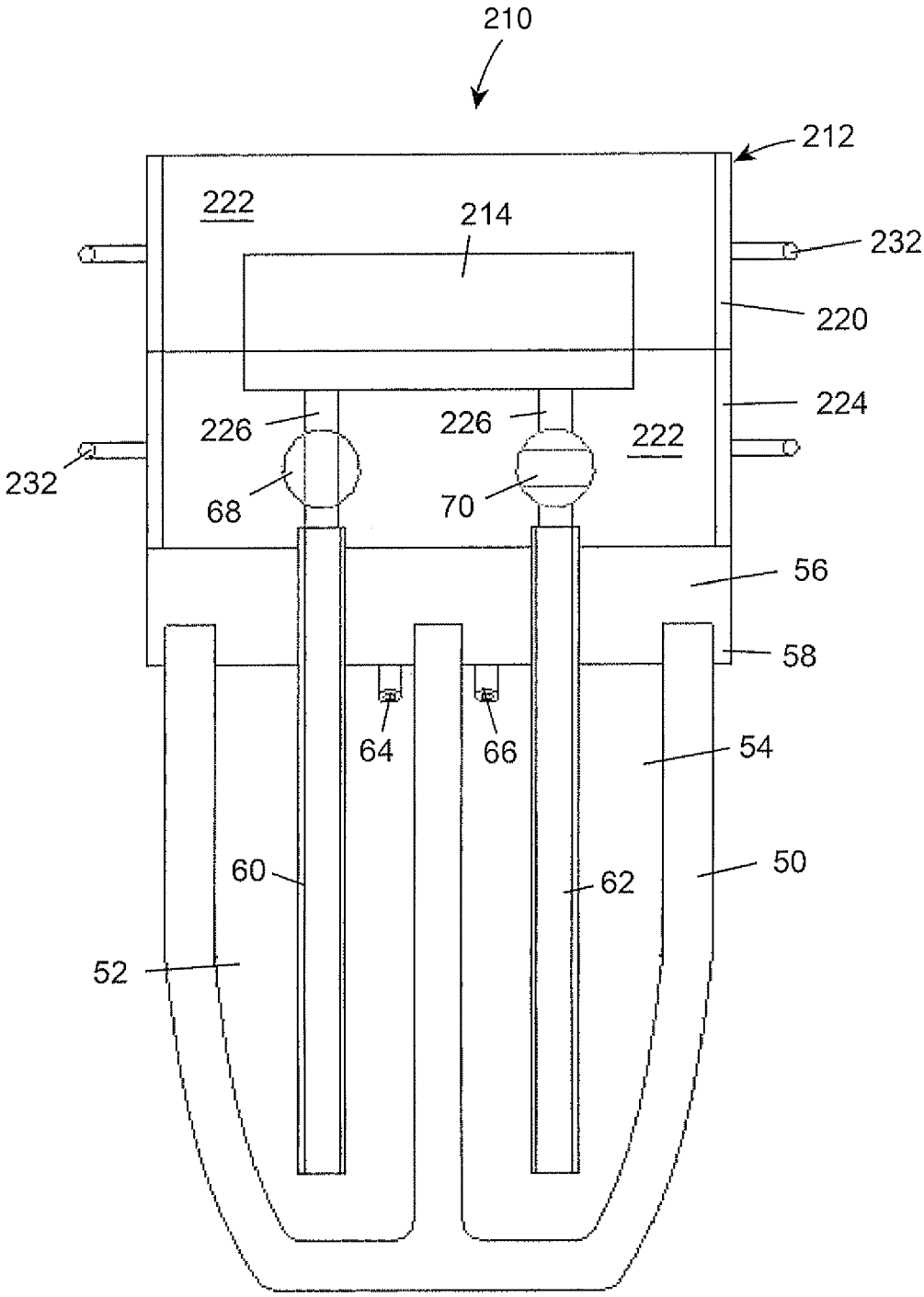
FIG. 3 illustrates a sectioned side elevation of a third embodiment of an apparatus for performing the method of the present invention.
Figure 4:
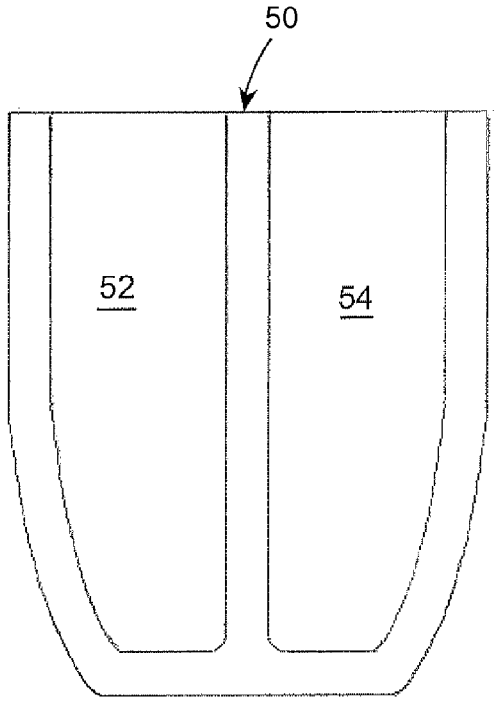
FIG. 4 illustrates a sectioned side elevation of a crucible forming part of the apparatus of FIG. 3.

As illustrated in FIG. 3, when the second sand box 224 is mounted to the lid 56, each of the channels 226 are in fluid communication with a respective one of the first feed tube 60 and the second feed tube 62. Thus there is provided a path from the first reservoir 52 into the cavity 214, and from the second chamber 54 into the cavity 214. Disposed within the channel 226 above the first feed tube 60 is a first valve 68, which is operable to permit or prevent the flow of material A between the first chamber 52 and the cavity 214, while a second valve 70 is located within the channel 226 above the second feed tube 62, the second valve 70 being operable to permit or prevent the flow of material B between the second chamber 54 and the cavity 214. The first and second valves 68, 70 may be of any suitable form, once capable of withstanding the temperatures which will be experienced within the apparatus 210 during use.

Figure 6:
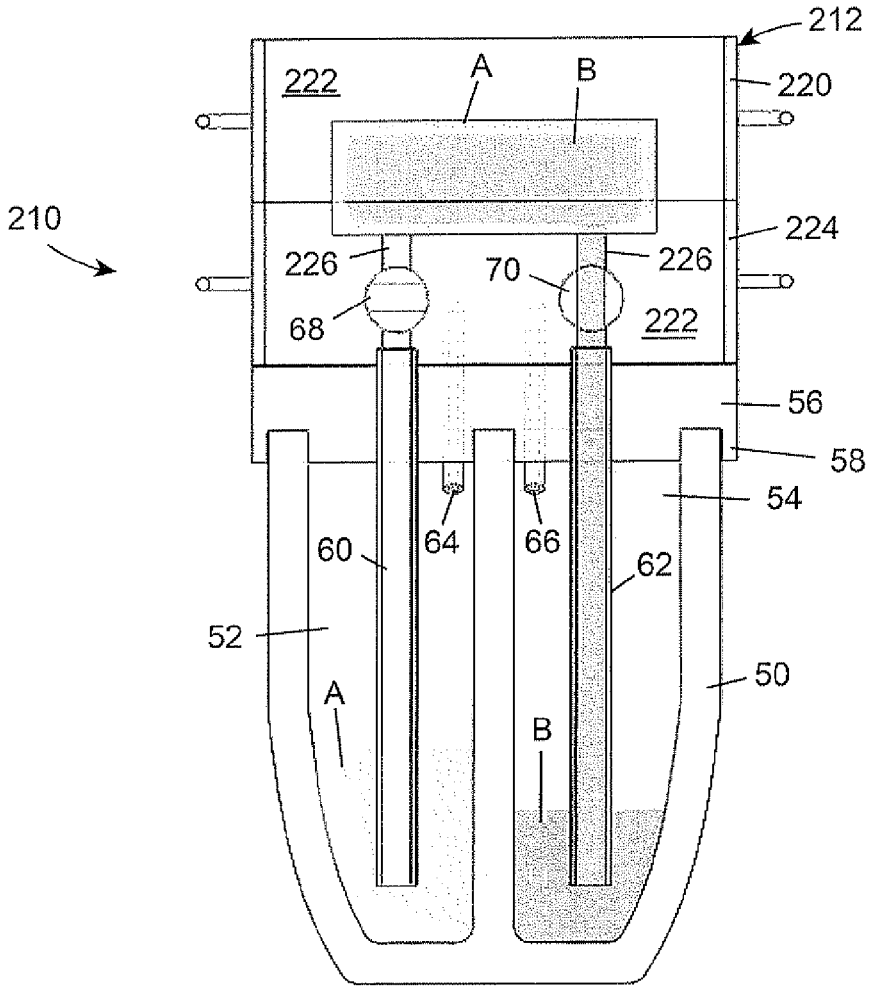
FIG. 6 illustrates a sectioned side elevation of the apparatus illustrated in FIG. 3, having a metal A and a metal B located therein.

Therefore, in use, and referring in particular to FIG. 6, a quantity of material A is located within the first chamber 52, and a quantity of material B within the second chamber 54. The lid 56 is then sealed onto the crucible 50, and the sand boxes 220, 224 mounted thereto as shown. The pair of valves 68,70 are initially located in the closed position. If not already done so, material A and material B are then melted, preferably by locating the crucible 50 within a furnace, most preferably an induction furnace. Alternately, material A and B can be melted in another furnace (not shown) and poured into the crucible 50, through their respective feed tubes 60, 62.

The first valve 68 is then opened, and gas is fed into the first chamber 52, under pressure, through the first pump tube 64. The gas pressure therefore forces the molten material A up the first feed tube 60, into the cavity 214 to fill same. The pressure is maintained for a specified period of time in order to allow material A to solidify along the surface of the cavity 214. The thickness of the solidified layer is controlled by the time the pressure is maintained within the first chamber 52. Once the solidified layer of material A has reached a desired thickness, the pressure is released, and thus the remaining liquid material A drains back down through the first feed tube 60 into the first chamber 52.

The first valve 68 is then closed, and the second valve 70 opened. If necessary, a device (not shown) could be used to puncture a hole through any solidified metal blocking the second feed tube 62. Pressure is then applied to the second chamber 54 via the second pump tube 66, thereby forcing the molten material B upwardly through the second feed tube 62, and into the cavity 214. The molten material B re-melts the surface layer of material A within the cavity 214, thereby creating a gradient interface between the two materials A, B. The pressure is maintained within the second chamber 54 until material B solidifies within the cavity 214, thereby assisting the avoidance of any shrinkage problems. The pressure is then released in order to allow the molten material B within the second feed tube 62 to drop back into the second chamber 54. The first sand box 220 may then be removed from the second sand box 224, in order to expose the completed functionally gradient component.

It will be appreciated that the crucible 50, or more particularly the first chamber 52 and the second chamber 54, could be replaced with two separate crucibles (not shown), which may be housed within an airtight chamber (not shown), preferably containing an induction furnace (not shown). The chamber may then be pressurised in order to pump material A and material B into the mould, with the use of suitable valving (not shown) preventing both material A and material B from being pumped into the mould at the same time. Alternatively, two separate chambers (not shown) could be used to house the two crucibles (not shown), if different holding temperatures were required for material A and material B.

Figure 7:
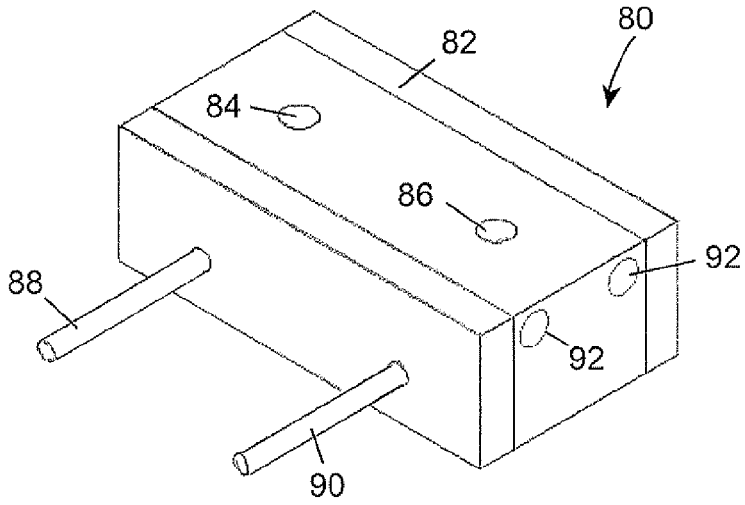
FIG. 7 illustrates a perspective view of a valve block which may be used with the apparatus illustrated in FIG. 3.

Referring to FIG. 7, the first and second valves 68, 70 could be replaced with a valve block 80 comprising a body 82 having a first through bore 84 and a second through bore 86 therein, each through bore 84, 86 having a valve (not shown) in operative association therewith, the valves (not shown) being operable by a respective first handle 88 and second handle 90. In addition, the valve block 80 is preferably provided with one or more heating chambers 92 extending inwardly of the body 82, into which heating elements (not shown) may be inserted in order to prevent solidification of material A or material B within the valve block 80. The valve block 80 would then preferably replace the entire second sand box 224, and the valves 68, 70, the first sand box 220 would then be mounted directly on the valve block 80. With such an arrangement, the entire cavity 214 would need to be located within the first sand box 220 or any other suitable mould (not shown).

The use of the valve block 80 avoids the need to carefully and accurately locate the valves 68, 70 within the compacted sand 222 of the second sand box 224, which can be a time consuming and difficult task.

Figure 8:
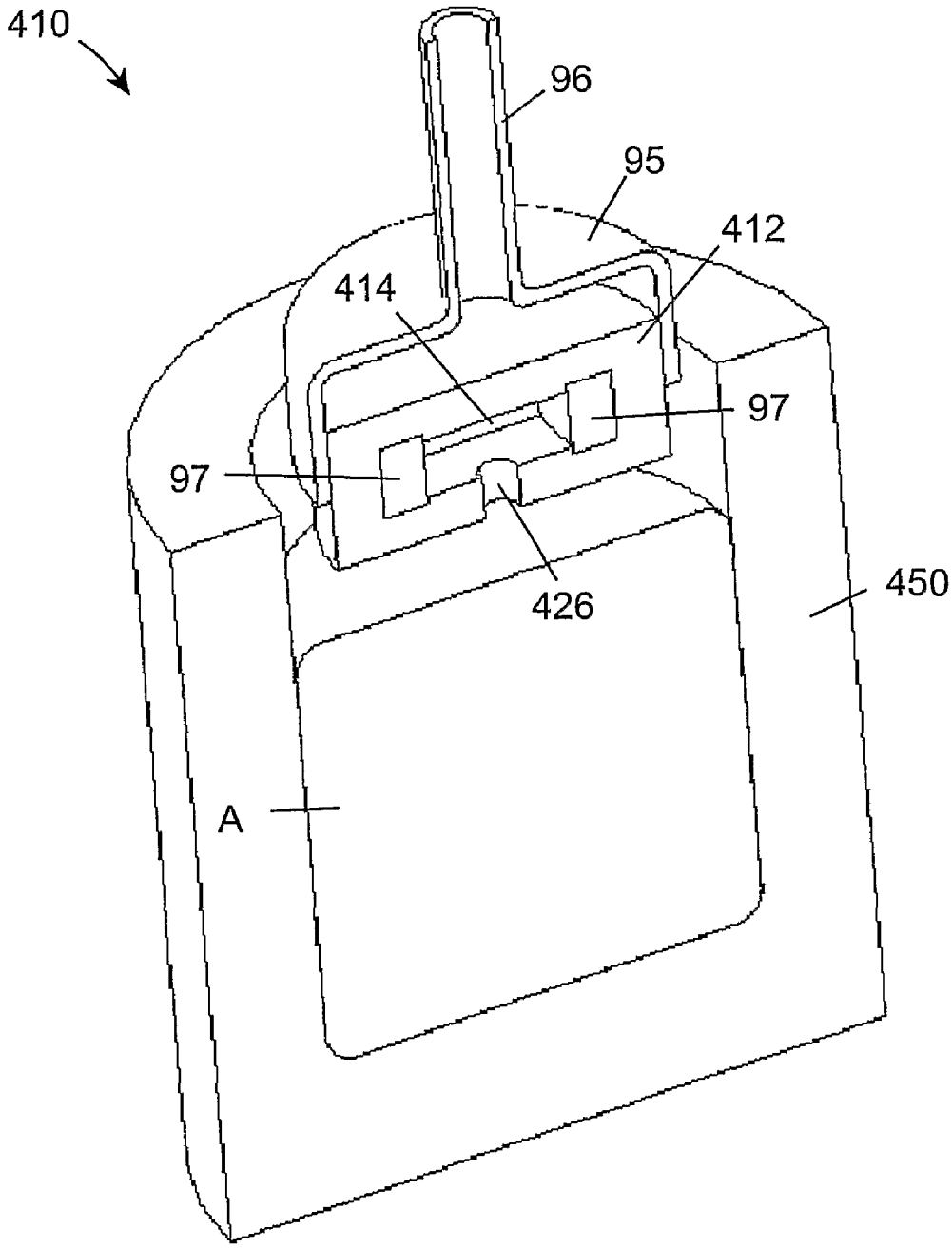
FIG. 8 illustrates a perspective sectioned view of a fourth embodiment of an apparatus for performing the method of the present invention, in which a mould is in a raised position.
Figure 9:
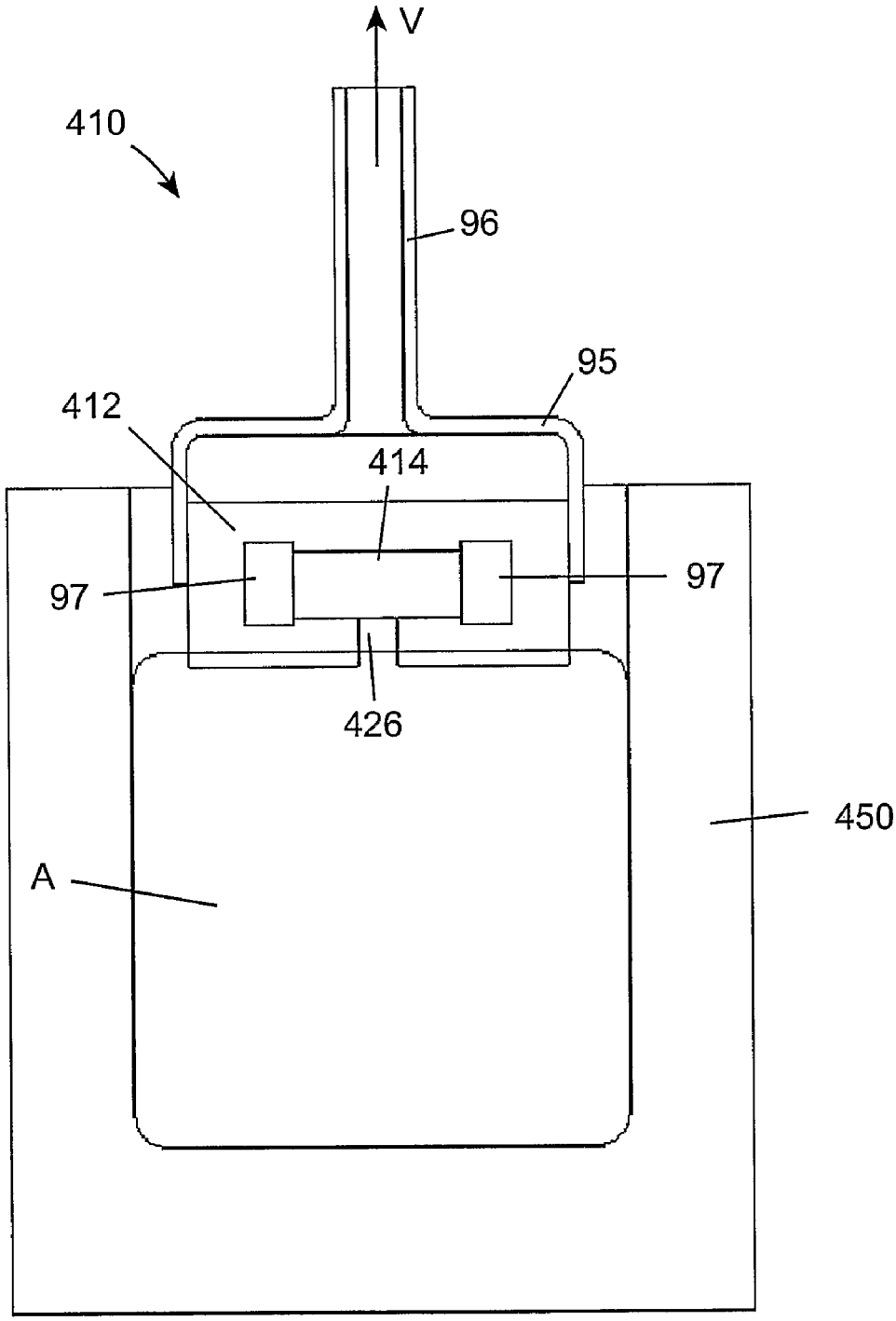
FIG. 9 illustrates a sectioned side elevation of the apparatus of FIG. 8, in which the mould is in a lowered position.

Referring to FIGS. 8 and 9, there is illustrates a fourth embodiment of an apparatus according to the present invention, generally indicated as 410, for performing the method of producing a functionally gradient component according to the present invention. The apparatus 410 is adapted to perform the vacuum casting of a functionally gradient component (not shown), as described hereinafter. The apparatus 410 comprises a mould 412, preferably formed from compacted sand, the mould 412 defining a cavity 414 therein, for casting the functionally gradient component (not shown) therein. The mould 412 is clamped or held within a vacuum cup 95, between which and the mould 412 is a fluid tight seal. Although the vacuum cup 95 is substantially circular in cross section, in the embodiment illustrated, it will be appreciated that any other suitable shape could be used.

Extending from the vacuum cup 95 is an suction tube 96 which, in use, is connected to a vacuum pump (not shown) or the like, in order to be capable of applying a negative pressure or vacuum to the mould 412, via the vacuum cup 95. As the mould 412 is formed from a porous sand, a vacuum will thus be created within the cavity 414. The mould is provided with a gate or channel 426 on the underside thereof, provided external access to the cavity 414. The mould may also be provided with chills 97 disposed at various locations around the mould 414, in order to control solidification of material within the mould 414, and thus the thickness of the material adjacent said chills 97.

Thus, in use, the mould 412, held within the vacuum cup 95, is positioned above a furnace 450, preferably an induction furnace, containing molten material A. The mould 414 is then lowered into material A, as illustrated in FIG. 9, and a vacuum applied to the vacuum cup 95, and thus the cavity 414, by drawing air up through the suction tube 96, in the direction of arrow V. Material A is therefore drawn up into the cavity 414, and begins to solidify against the walls thereof. After material A has reached a desired thickness, the vacuum is released from the vacuum cup 95, and the molten portion of material A within the cavity 414 pours back into the furnace 450 under gravity.

The mould 412 and the vacuum cup 95 are quickly transferred to a second furnace (not shown), preferably of the same type as the first furnace 450, although containing molten material B (not shown). The above process is then repeated, with the mould 412 being lowered into material B, and a vacuum being applied to the cavity 414, in order to draw molten material B into the cavity 414 to form a core within the skin of material A. The vacuum is maintained until material B is fully solidified.

It will of course be appreciated that material B could be release back into the second furnace (not shown) after the partial solidification thereof, and a third material (not shown) introduced into the cavity 414, and so on.

This type of vacuum casting is generally known as Countergravity Low pressure Air melt (CLA). A common variant is the Countergravity Low pressure Vacuum melt (CLV) process. The difference between the two processes is that with CLA, metal is normally melted open to the atmosphere, while with CLV, the metal is melted in a vacuum. CLV is therefore generally used for reactive metals that cannot be melted in air.

It should be noted that the above described embodiments are relatively simple means of effecting the method of the present invention, and various modifications or improvements could be made to same. For example, suitable reservoirs of hot material, normally known as feeders (not shown) could be provided to control the solidification rates of material A and material B, particularly to avoid solidification of the runners before material A and/or material B in the cavity 214, as this could lead to shrinkage problems and difficulties with using a second mould (not shown) in a production run. In addition, suitable chills (not shown) could be provided around the mould 212, in order to control the solidification rates and to target material A towards specific areas of the component to be produced, for example on a particular surface or part of a surface. Alternatively, a metal mould (not shown), or a mould of any other suitable material, could be used with heated or cooled sections to control solidification.

It should also be apparent that any other suitable casting process could be adapted for use with the method according to the present invention. For example, the Hitchiner Process is an investment casting process where molten metal is drawn up into a mould (not shown) by applying a partial vacuum to an air tight chamber around the mould. A tube (not shown) extends downwardly from the mould into a bath or crucible of the molten metal, thereby facilitating suction of the molten metal into the mould. Drawing the molten metal up into the mould in this fashion allows for a very controlled filling rate and very low levels of impurities in the cast product (not shown). Thus the method of the present invention could be adapted to the Hitchiner process by providing two baths of molten metal, one containing material A, and one containing material B. The mould (not shown) may be prepared in a similar fashion to the standard Hitchiner process, but may have chills (not shown) inserted at desired locations in order to produce increased solidification points for material A. The mould is then placed above the bath of material A, with the gate tube below the surface of the molten material A. Material A is then drawn up into the mould by applying a vacuum to the mould, and after a specified time, when a sufficient amount of material A has solidified on the walls of the mould (not shown), or has solidified only on the chills (not shown), the vacuum is released and the remaining molten portion of material A is decanted back into the bath or crucible (not shown). The mould or the crucible is then moved so that the mould is above the second bath or crucible (not shown) containing molten material B, again with the tube of the mould extending below the surface of material B. The vacuum is again used to draw material B upwardly to fill the remaining part of the mould. Material B combines with the mushy exposed surface layer of material A and forms a gradient microstructure. When material B is fully solidified in the mould the vacuum is released. If desired, the vacuum could be released after the individual components are solidified but before a runner (not shown) solidifies in order to aid in the manufacturing process.

A further casting process which may be adapted for use with the method of the present invention is the Cosworth process, which is a variation on the low pressure casting process. The key difference with the Cosworth process is the use of metal pumps to transfer molten metal into a mould (not shown), rather than applying a gas pressure difference to a sealed crucible (not shown).

It is also worth noting that while the method of producing a functionally gradient component according to the present invention is primarily intended to be employed in producing a finished or substantially finished product (not shown), the method of the present invention also has the potential to produce blooms, slabs, billets (not shown) etc for the production of wrought metal products or the like. For example, an ingot (not shown) could be produced according to the method of the present invention, using any one of the processes described above, and a functionally gradient wrought metal product (not shown) could then be produced using one or more of a number of extrusion processes or the like, for example hot rolling, cold drawing, etc. Such an ingot (not shown) could also be used in a forging process, for example drop forging or the like.

The method according to the present invention may also be used to produce a bulk metallic glass (BMG) component, or a component having an outer layer of a bulk metallic glass. BMG is a relatively new material produced by super cooling liquid metal to form a vitreous solid having unusually high strength, wear and corrosion resistance, and elasticity, in addition to a number of other beneficial characteristics. This new type of material was discovered at the California Institute of Technology in 1960, and has been the subject of much research and commercial activity since, particularly over the last decade. However, heat conduction in BMG is slow, and thus the required cooling rate can only be achieved for a relatively small casting thickness. The method of the present invention could be used to create BMG through serial casting and decanting, allowing a BMG component to be built up in layers, by virtue of only a thin layer solidifying at a given time, allowing the required cooling rates to be achieved. This method could also be adapted to combine a BMG with a crystalline material, with an intermediate or a transitional layer being a partially glassy zone. This process would involve the initial casting of a layer of BMG by using a sufficiently high cooling rate at a wall or portions of a wall of a mould (not shown), and then decanting the remaining liquid material, and subsequently casting a crystalline core inside the BMG layer. The transitional layer between the BMG outer layer and the crystalline core would then be a partially glassy zone.

The present invention therefore provides a relatively simple method of producing a functionally gradient component, in particular a lightweight metal component formed from, for example two or more aluminium alloys, which has an outer layer with particular properties, for example wear resistance, and at least one inner layer or core having different properties, for example shock resistance or the like.

The invention claimed is:

1. A method of producing a functionally gradient component, the method comprising introducing a first material, in a molten state, into a mould; allowing a layer of the first material to at least partially solidify against a wall of the mould; decanting a remaining molten portion of the first material; introducing a second material, in a molten state, into the mould; and remelting the exposed surface of the first material by the addition of the molten second material such as to effect convection and mixing at the interface between the first and second materials to produce a gradual change in microstructure between the first and second materials.

2. A method according to claim 1 in which at least the decanting step is undertaken in a reducing gas atmosphere.

3. A method according to claim 1 comprising, immediately introducing the second material into the mould after the decanting of the first material, such as to prevent oxidation of the layer of the first material.

4. A method according to claim 1 comprising the additional step of altering the temperature at one or more locations on the wall of the mould, prior to introducing the first material, in order to achieve a desired thickness of the layer of the first material at said one or more locations.

5. A method according to claim 1 comprising, in the step of introducing the first material, introducing the first material into the mould under pressure.

6. A method according to claim 1 comprising, in the step of introducing the second material, introducing the second material into the mould under pressure.

7. A method according to claim 1 comprising the additional step of pre-heating at least a portion of the mould prior to the introduction of the first material.

8. A method according to claim 6 comprising the additional step of maintaining the second material under pressure within the mould until the second material has substantially solidified.

9. A method according to claim 1 comprising the additional steps of allowing a layer of the second material to at least partially solidify on the layer of the first material; decanting the remaining molten portion of the second material; and introducing a third material, in a molten state, into the mould.

* * * * *